US011306907B2

(12) United States Patent
Gao

(10) Patent No.: US 11,306,907 B2
(45) Date of Patent: Apr. 19, 2022

(54) LIGHTING APPARATUS

(71) Applicant: OPPLE LIGHTING CO., LTD., Shanghai (CN)

(72) Inventor: Yongfu Gao, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/105,194

(22) Filed: Nov. 25, 2020

(65) Prior Publication Data

US 2021/0080091 A1 Mar. 18, 2021

Related U.S. Application Data

(63) Continuation of application No. PCT/CN2019/086642, filed on May 13, 2019.

(30) Foreign Application Priority Data

May 29, 2018 (CN) ..... 201820818346.6

(51) Int. Cl.
*F21S 8/02* (2006.01)
*F21V 23/00* (2015.01)
(Continued)

(52) U.S. Cl.
CPC ..... *F21V 23/002* (2013.01); *F21S 8/02* (2013.01); *F21V 17/10* (2013.01); *F21V 27/00* (2013.01); *F21Y 2115/10* (2016.08)

(58) Field of Classification Search
CPC ..... F21V 23/002; F21V 27/00; F21V 17/10; F21S 8/02
See application file for complete search history.

(56) References Cited

U.S. PATENT DOCUMENTS 7,828,463 B1 * 11/2010 Willis ..... F21V 23/0442 362/276
9,435,521 B2 * 9/2016 Chen ..... H01L 33/60
(Continued)

FOREIGN PATENT DOCUMENTS

| | | |
|---|---|---|
| CN | 107270246 A | 10/2017 |
| CN | 208139045 U | 11/2018 |
| EP | 2206945 B1 | 2/2013 |

OTHER PUBLICATIONS

International Search Report of PCT Application No. PCT/CN2019/086642 dated Aug. 20, 2019 with English translation, (4p).

*Primary Examiner* — Arman B Fallahkhair
(74) *Attorney, Agent, or Firm* — Arch & Lake LLP

(57) ABSTRACT

The present disclosure discloses a lighting apparatus and relates to a lighting field. The lighting apparatus includes an outer housing, an inner housing, a face ring, a functional module and a first conductive wire. A portion of the inner housing is arranged inside an accommodating cavity and separates the accommodating cavity of the housing into a light source cavity and a via cavity; the face ring is located outside the accommodating cavity and connected with the inner housing, and encloses to form an installation cavity; the installation cavity is sequentially in communication with the via cavity and the first via hole, so that the functional module mounted in the installation cavity may be electrically connected with the first conductive wire; and the first conductive wire sequentially passes through the via cavity and the first via hole to extend out of the housing.

16 Claims, 5 Drawing Sheets

(51) Int. Cl.

| | |
|---|---|
| ***F21V 17/10*** | (2006.01) |
| ***F21V 27/00*** | (2006.01) |
| *F21Y 115/10* | (2016.01) |

(56) References Cited

U.S. PATENT DOCUMENTS

| | | | | |
|---|---|---|---|---|
| 9,820,350 | B2 * | 11/2017 | Pyshos | F21S 8/026 |
| 9,964,266 | B2 * | 5/2018 | Danesh | H04R 23/02 |
| 10,260,722 | B2 * | 4/2019 | Treible, Jr. | H01Q 19/06 |
| 10,733,944 | B2 * | 8/2020 | Kumar | H05B 45/20 |
| 11,060,705 | B1 * | 7/2021 | Danesh | F21V 23/02 |
| 2014/0021884 | A1 * | 1/2014 | Fetterly | F21V 29/77 315/297 |
| 2017/0307143 | A1 * | 10/2017 | Shah | F21K 9/90 |
| 2021/0003273 | A1 * | 1/2021 | Hou | F21V 21/40 |
| 2021/0033251 | A1 * | 2/2021 | Yuan | F21V 21/02 |

* cited by examiner

LIGHTING APPARATUS

CROSS-REFERENCE TO RELATED APPLICATIONS

This application is based upon and claims the priority of PCT patent application No. PCT/CN2019/086642 filed on May 13, 2019 which claims priority to the Chinese patent application No. 201820818346.6 filed on May 29, 2018, the entire content of all of which is hereby incorporated by reference herein for all purposes.

TECHNICAL FIELD

The present disclosure relates to a lighting field, and more particularly, to a lighting apparatus and a method of manufacturing a lighting apparatus.

BACKGROUND

In addition to a light source module used for emergency lighting, a lighting apparatus for fire emergency use may also need to be provided with a functional module that implements a detecting function, an indicating function or a warning function.

SUMMARY

The present disclosure provides a lighting apparatus and a method of manufacturing a lighting apparatus.

The present disclosure provides a lighting apparatus. The apparatus may include an outer housing, an inner housing, a face ring, a functional module, and a first conductive wire. The outer housing may have an accommodating cavity and a first via hole; a portion of the inner housing may extend into the accommodating cavity and may separate the accommodating cavity into a light source cavity and a via cavity; the face ring may be located outside the accommodating cavity, and together with the inner housing, may enclose to form an installation cavity; the installation cavity may be sequentially in communication with the via cavity and the first via hole; the functional module may be mounted in the installation cavity and may be electrically connected with the first conductive wire; and the first conductive wire may sequentially pass through the via cavity and the first via hole to extend out of the outer housing.

The present disclosure also provides a method of manufacturing a lighting apparatus. The method may include: providing an outer housing, an inner housing, a face ring, a functional module, and a first conductive wire; providing the outer housing with an accommodating cavity and a first via hole; extending a portion of the inner housing into the accommodating cavity and separating the accommodating cavity into a light source cavity and a via cavity; locating the face ring outside the accommodating cavity, and forming an installation cavity by enclosing the face ring and the inner housing; sequentially communicating the installation cavity with the via cavity and the first via hole; and mounting the functional module in the installation cavity and electrically connecting the functional module with the first conductive wire; and sequentially passing the first conductive wire through the via cavity and the first via hole to extend out of the outer housing.

It is to be understood that both the foregoing general description and the following detailed description are exemplary and explanatory only and are not restrictive of the present disclosure.

BRIEF DESCRIPTION OF THE DRAWINGS

The drawings illustrated here are provided for further understanding the present disclosure and constitute a part of the present disclosure, and are used for explaining the present disclosure together with the examples of the present disclosure and description thereof, rather than improperly limiting the present disclosure. In the drawings.

DETAILED DESCRIPTION

Figure 1:
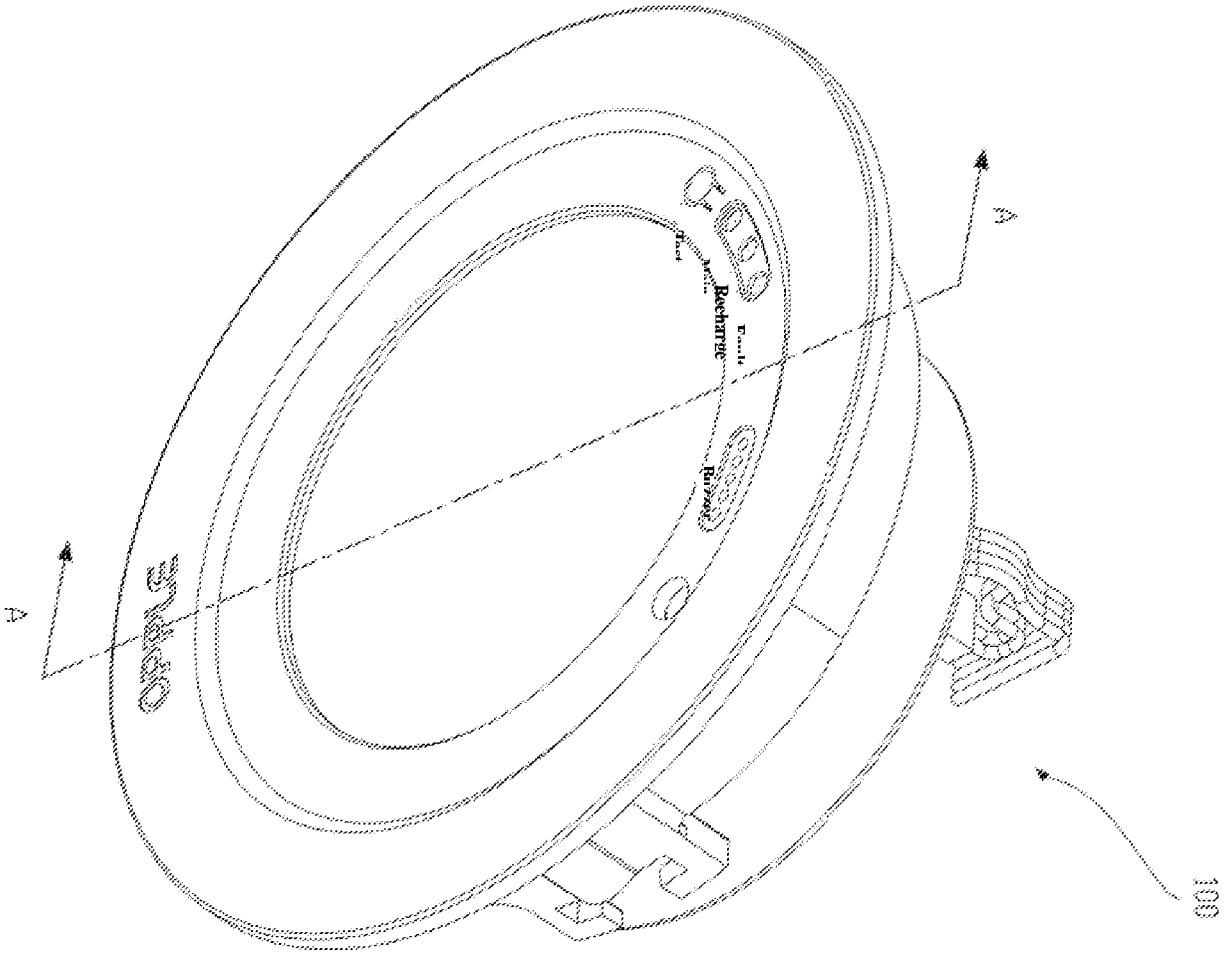
FIG. 1 is a schematic diagram of a lighting apparatus in an example of the present disclosure.

To make the objectives, technical solutions, and advantages of the present disclosure clearer, the technical solutions of the present disclosure will be described below in conjunction with the examples of the present disclosure and the corresponding drawings. The described examples are only a part of examples of the present disclosure, but not all the examples. Based on the examples of the present disclosure, all other examples obtained by those ordinarily skilled in the art without creative efforts fall within the protection scope of the present disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference numerals used in this disclosure may include:

100—lighting apparatus;

10—outer housing; 11—accommodating cavity; 111—light source cavity; 112—via cavity; 12—first via hole; 13—side wall; 14—bottom wall; 15—connecting plate; 151—second connecting hole; 152—third positioning structure; 16—ground end;

20—inner housing; 21—first portion; 211—first wall; 212—second wall; 213—first via notch; 22—second portion; 221—second via notch; 23—third portion; 231—second positioning structure; 232—second via hole;

30—face ring; 31—light emergent port; 32—mounting portion; 321—first mounting hole; 322—second mounting hole; 323—mounting post; 33—first connecting portion; 34—second connecting portion; 341—first positioning structure; 3411—circumferential positioning stage; 3412—axial positioning stage; 342—first connecting hole;

40—functional module; 41—control panel; 42—signal lamp; 43—voice prompter;

51—first conductive wire; 52—second conductive wire;

60—installation cavity;

70—light distributing component.

The lighting apparatus sometimes includes a housing which is provided with a light emergent port and a light source cavity, as well as a panel connected with the light emergent port of the housing. In order that the functional module can implement detection, and an indicating or warning signal sent by the functional module can be intuitively acquired, an indicating module needs to be mounted on the panel, and a conductive wire connected with the functional module passes through the light source cavity and then goes out of the housing.

However, because the conductive wire passes through the light source cavity, optical path transmission in the light source cavity may be affected, causing light efficiency of the lighting apparatus to be reduced.

Figure 2:
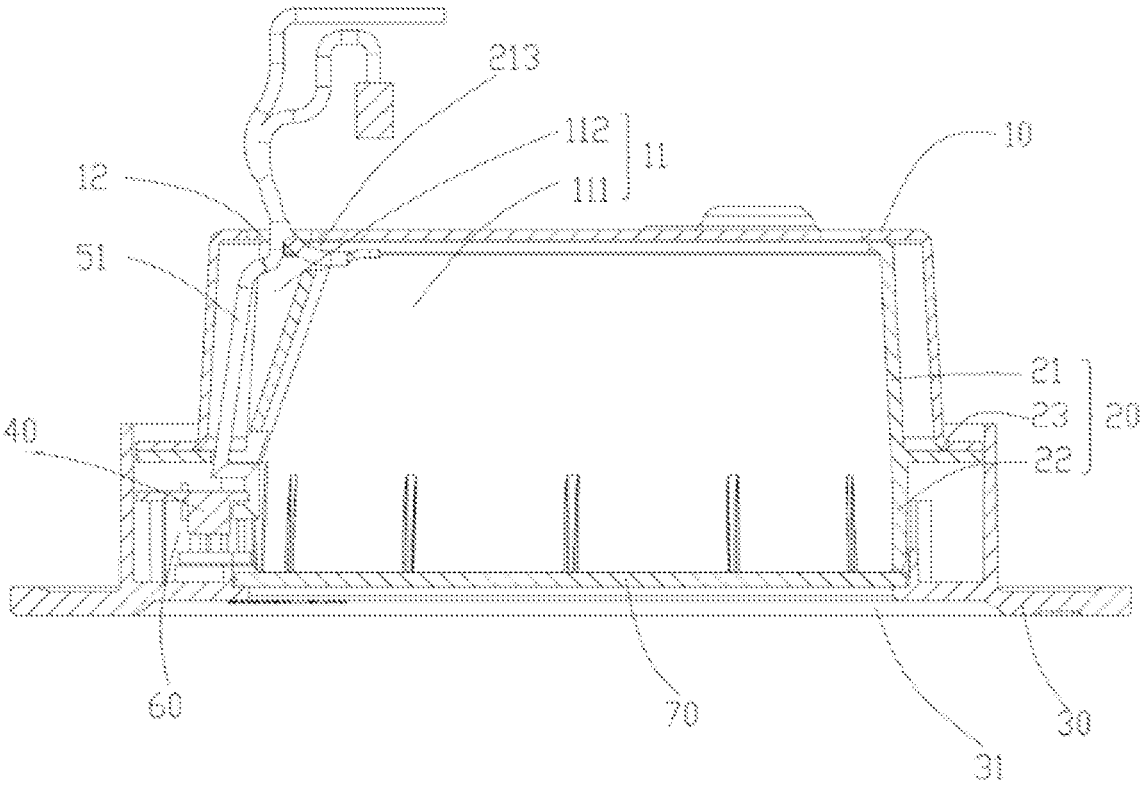
FIG. 2 is a cross-sectional view of the lighting apparatus in FIG. 1 taken along A-A.

As shown in FIG. 1 and FIG. 2, a lighting apparatus 100 provided by an example of the present disclosure comprises an outer housing 10, an inner housing 20, a face ring 30, a functional module 40 and a first conductive wire 51. The outer housing 10 has an accommodating cavity 11 and a first via hole 12; a first portion 21 of the inner housing 20 extends into the accommodating cavity 11 and separates the accommodating cavity 11 into a light source cavity 111 and a via cavity 112, that is, the first portion 21 of the inner housing 20 separates the outer housing 10 into the light source cavity 111 for light transmission and the via cavity 112 for arranging conductive wires. The face ring 30 is arranged outside the accommodating cavity 11; the face ring 30 and the inner housing 20 jointly enclose to form an installation cavity 60; and the installation cavity 60 is sequentially in communication with the via cavity 112 and the first via hole 12. The functional module 40 is mounted in the installation cavity 60 and is electrically connected with the first conductive wire 51; the first conductive wire 51 sequentially passes through the via cavity 112 and the first via hole 12 and then goes out of the outer housing 10, that is, the first conductive wire 51 will not pass through the light source cavity 111, so that the first conductive wire 51 is prevented from interfering with light in the light source cavity 111. In addition, the functional module 40 is arranged in the installation cavity 60, so that the functional module 40 is also prevented from blocking light emergent from the light source cavity 111.

The face ring 30 may be connected with the inner housing 20, so as to enclose the installation cavity 60; and the connection includes direct connection or indirect connection. The face ring 30 may also be separated from the inner housing 20, for example, the face ring 30 is located in just front of the wall, and the inner housing 20 and the outer housing 10 are mounted inside the wall.

Figure 3:
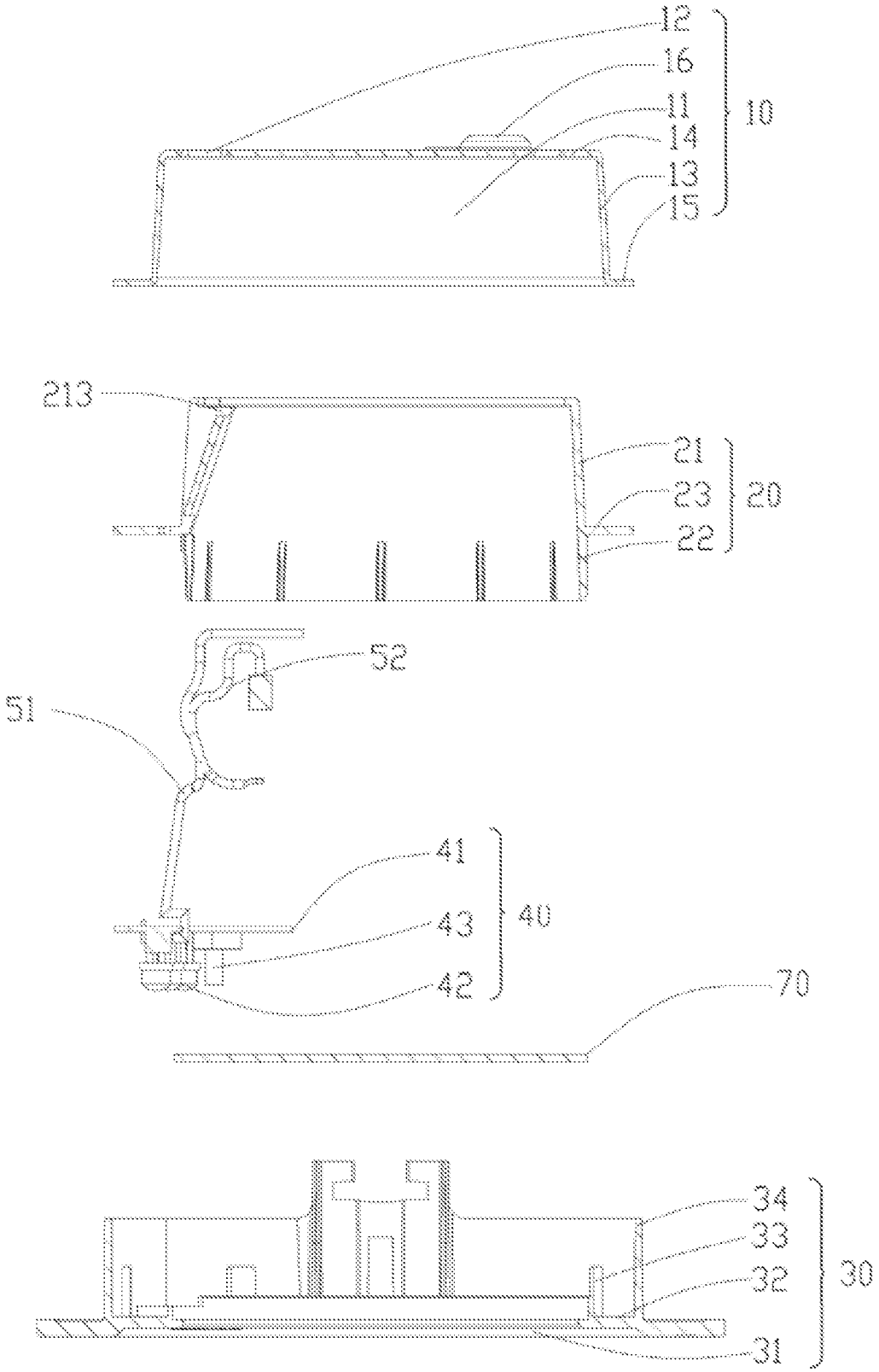
FIG. 3 is an exploded view of the cross-sectional view in FIG. 2.
Figure 4:
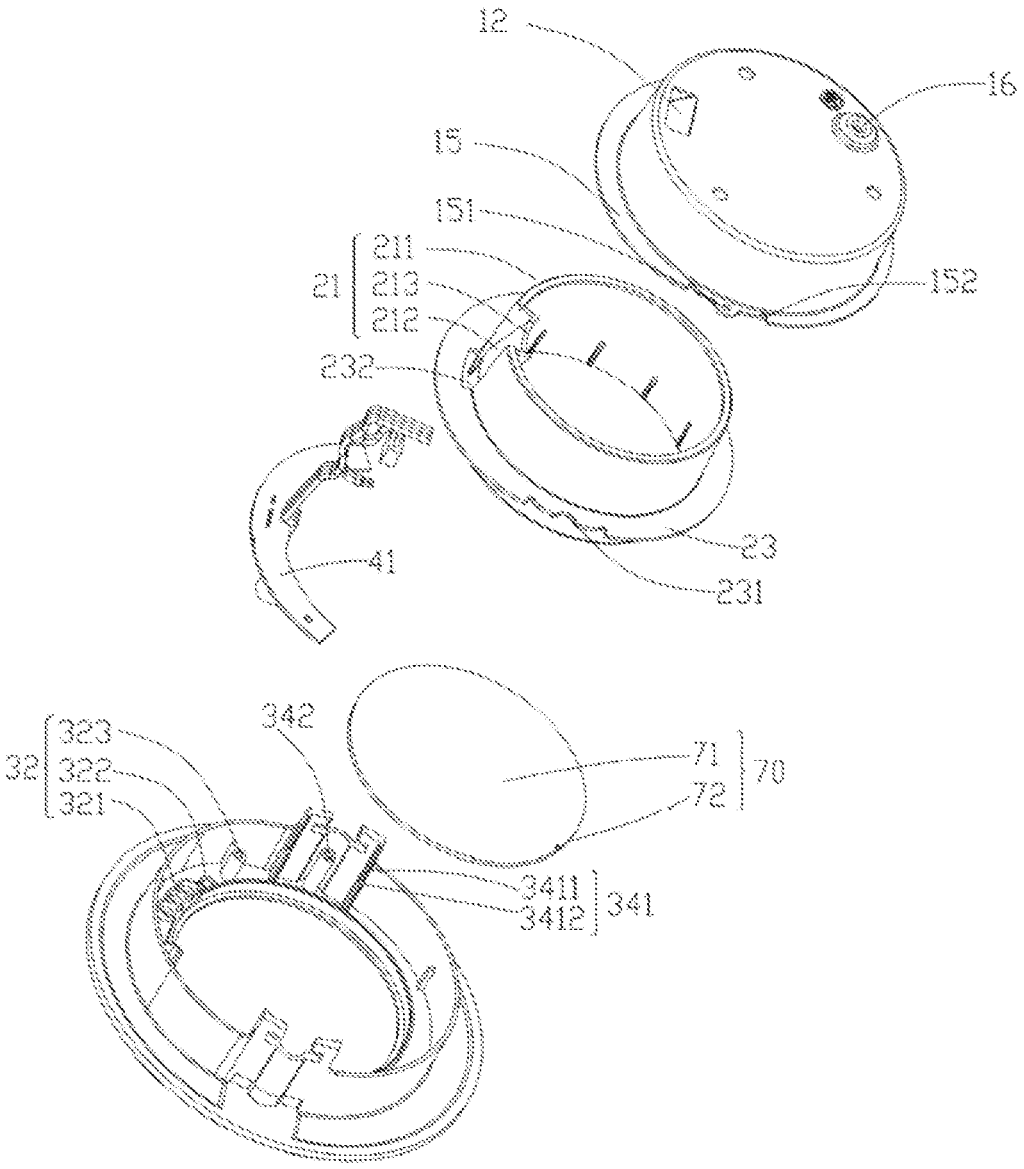
FIG. 4 is an exploded view of the lighting apparatus in FIG. 1 from a visual perspective.

In conjunction with FIG. 2, FIG. 3 and FIG. 4, the outer housing 10 has a side wall 13, a bottom wall 14 and an accommodating cavity opening (not labeled); the side wall 13 is arranged to surround the bottom wall 14 and forms the accommodating cavity opening; the bottom wall 14 and the accommodating cavity opening are arranged opposite to each other. The first portion 21 of the inner housing 20 extends from the accommodating cavity opening towards the bottom wall 14; the first portion 21 has a first face (not labeled) and a second face (not labeled) that face away from each other; the first face faces the via cavity 112; and the second face faces the light source cavity 111; wherein the second face may be a mirror reflective surface.

The first portion 21 may have a loop shape, that is, a projection of the first portion 21 on the bottom wall 14 has a loop shape. The first face may face towards the outside of the loop shape; and the second face may face towards the inside of the loop shape. The lighting apparatus 100 further comprises a light source module (not shown) mounted within the light source cavity 111. A region of the bottom wall 14 that is surrounded by the second face is a light source module mounting region; the light source module is mounted on the light source module mounting region; a region of the bottom wall 14 that is enclosed by the first face and the side wall 13 is a via region; the first via hole 12 may be arranged on the via region. As a modified example, the first face may face the inside of the loop shape; the second face may face the outside of the loop shape; then a loop-shaped region of the bottom wall 14 that is enclosed by the second face and the side wall 13 is the light source module mounting region; the light source module is mounted on the light source module mounting region; the region of the bottom wall 14 that is surrounded by the first face is the via region; and the first via hole 12 may be arranged in the via region.

Specifically, the first portion 21 may be a structure having a circular loop shape, or an elliptical loop shape, or other irregular loop shape, or may also be an open loop or a closed loop. In the example of the present disclosure, along a circumferential direction of the accommodating cavity opening, the first portion 21 may be divided into a first wall 211 and a second wall 212; the first wall 211 has an arc shape and maintains a first distance from the side wall 13; the second wall 212 is connected with the first wall 211 and forms a closed loop shape together with the first wall 211; the second wall 212 maintains a second distance from the side wall 13; the second distance is greater than the first distance, so the via cavity 112 enclosed by the second wall 212 and the side wall 13 may be formed. In some examples, the first wall 211 may be attached to the side wall 13, and the second wall 212 maintains a distance from the side wall 13, so that space of the accommodating cavity 11 in the outer housing 10 may be wasted as little as possible, making the light source cavity 111 to have a larger volume. That is, except for the via cavity 112 used for the conductive wires to pass through, remaining space of the accommodating cavity 11 is all used as the light source cavity 111. It is contemplated that, in order to make the light source cavity 111 larger, the via cavity 112 only needs to have a size suitable for arranging the conductive wires.

A side of the first portion 21 that is close to the bottom wall 14 is provided with a first via notch 213; and the first via notch 213 communicates with the light source cavity 111 and the via cavity 112. The lighting apparatus 100 comprises a second conductive wire 52 electrically connected with the light source module; and the second conductive wire passes through the first via notch 213, the via cavity 112, and the first via hole 12, and then goes out of the outer housing 10. Except for the first via notch 213, the side of the first portion 21 that is close to the bottom wall 14 may be attached to the bottom wall 14.

It should be noted that, although the second conductive wire 52 is connected with the light source module in the light source cavity, the second conductive wire 52 may be connected with the light source module in a position close to the first via notch 213, making the second conductive wire 52 have a smaller length in the light source cavity 111, which will not significantly affect an optical path of the lighting apparatus 100. Secondly, the second conductive wire 52 is usually attached to the light source module and bypasses a light-emitting unit, that is, the second conductive wire 52 bypasses the optical path of the light source module, so it will not affect light efficiency or the optical path of the lighting apparatus. Furthermore, in the example of the present disclosure, the first via notch 213 is closely adjacent to the bottom wall 14, so that the second conductive wire 52 may be closely attached onto the bottom wall 14 or the light source module instead of being arranged in a central position of the light source cavity 111, which naturally avoids influence on the optical path.

The first portion 21 separates the accommodating cavity opening into a light source cavity opening and a via cavity opening; and the via cavity opening may surround the light source cavity opening. The face ring 30 has a light emergent port 31, a mounting portion 32, a first connecting portion 33, and a second connecting portion 34; and the face ring 30, outwardly from a radial plane of the light emergent port 31, successively includes: the light emergent port 31, the first connecting portion 33, the mounting portion 32, and the second connecting portion 34; the light emergent port 31 and the light source cavity opening are arranged opposite to each other; the mounting portion 32 and the via cavity opening are arranged opposite to each other; and the second connecting portion 34 extends towards the bottom wall 14. That is, the first connecting portion 33 surrounds the light emergent port 31; the mounting portion 32 surrounds and is connected to the first connecting portion 33; and the second connecting portion 34 surrounds and is connected to the mounting portion 32, and the second connecting portion 34 extends towards the bottom wall 14. In other words, the face ring 30 may have a ring-shaped structure; the light emergent port 31 is located within the ring shape; and the first connecting portion 33, the mounting portion 32, and the second connecting portion 34 are respectively arranged along the radial plane outwardly from a center of the ring shape.

The inner housing 20 includes a second portion 22 and a third portion 23; the second portion 22 extends from the first portion 21 along a direction facing away from the bottom wall 14 and is connected with the first connecting portion 33; and the third portion 23 extends outwardly from the first portion 21 along a radial plane of the accommodating cavity opening and is connected with the second connecting portion 34. The mounting portion 32, the second connecting portion 34, the second portion 22, and the third portion 23 enclose to from the installation cavity 60; the functional module 40 has a control panel 41; and the control panel 41 is located within the installation cavity 60, such that a direct contact with the control panel 41 from the outside of the lighting apparatus 100 can be avoided.

A mounting post 323 extending from the mounting portion 32 toward the third portion 23 is provided in the installation cavity 60; a threaded hole for screw connection with the control panel 41 is provided in an end surface of the mounting post 323 facing towards the third portion 23. The control panel 41 in the installation cavity 60 may have a ring shape or an arc shape.

As a modified example, the second portion 22 may not be connected with the first connecting portion 33, but may be connected with the second connecting portion 34; the third portion 23 extends inwardly from the first portion 21 along the radial plane of the accommodating cavity opening and then is connected with the first connecting portion 33; and the installation cavity 60 is also enclosed by the mounting portion 32, the second connecting portion 34, the second portion 22, and the third portion 23.

When the outer housing 10 is made of a metal material, the control panel 41 is located within the installation cavity 60, which may increase a creepage distance between the control panel 41 and the outer housing 10. In order to improve safety, the face ring 30 and the inner housing 20 may be made of electrically insulating materials, so that electrically insulation protection of the control panel 41 in the installation cavity 60 may be implemented. In addition, in order that heat of the light source module dissipates more quickly, the outer housing 10 may be made of a metal material with better thermal conductivity, and an outer surface of the outer housing 10 may also be provided with a ground end 16.

The third portion 23 extends outwardly from the first portion 21 along the radial plane, that is, the third portion 23 separates the installation cavity 60 from the via cavity 112 along a direction of the radial plane. The third portion 23 covers the via cavity opening and separates the installation cavity 60 from the via cavity 112; and the third portion 23 is provided with a second via hole 232 for communicating the via cavity with the installation cavity, so as to make the via cavity 112 and the installation cavity 60 being in communication with each other; so that the first conductive wire 51 can extend into the installation cavity 60 to be electrically connected with the control panel 41, and pass through the second via hole 232, the via cavity 112 and the first via hole 12 to extend out of the outer housing 10. The first via hole 12 and the via cavity opening may be arranged opposite to each other in an axial direction of the accommodating cavity opening. The installation cavity 60 includes a first mounting hole 321 arranged on the mounting portion 32 and in communication with the outside; the functional module 40 may include a signal lamp 42; the signal lamp 42 is mounted on the first mounting hole 321 and is electrically connected with the control panel 41. The signal lamp 42 is used to emit an indicating light signal, and convert the indicating signal under the driving of the control panel 41. Herein, the indicating lamp may be an LED lamp.

The functional module 40 may further include a voice prompter 42; and the installation cavity 60 further includes a second mounting hole 322 arranged on the mounting portion 32 and in communication with the outside. The voice prompter 42 is mounted on the second mounting hole 322 and electrically connected with the control panel 41, and can emit a voice prompt under the driving of the control panel 41. The voice prompter 42 may be a horn or a buzzer.

The lighting apparatus 100 may comprise a light distributing component 70 covering the light emergent port 31; and the light distributing component 70 may be a diffusing panel. The light distributing component 70 is connected onto the first connecting portion 33 of the face ring 30 along a circumferential direction thereof. The light distributing component 70 includes a central light distributing region 71 and a mounting region 72 surrounding the light distributing region along the circumferential direction; the light distributing region 71 is aligned with the light emergent port 31; and the mounting region 72 is sandwiched between the first connecting portion 33 and the second portion 22. In addition, a fool-proofing structure (not labeled) is provided on the mounting region 72 which is connected with the first connecting portion 33, so that the light distributing component 70 may be positioned in the circumferential direction of the face ring 30.

The light distributing component 70 may be provided with a third mounting hole (not shown) which communicates with the light source cavity 111 and the outside. The functional module 40 may further include a detector (not shown); and the detector is mounted on the third mounting hole and is electrically connected with the control panel 40. The detector may be an infrared detector or a detector of other type.

Figure 5:
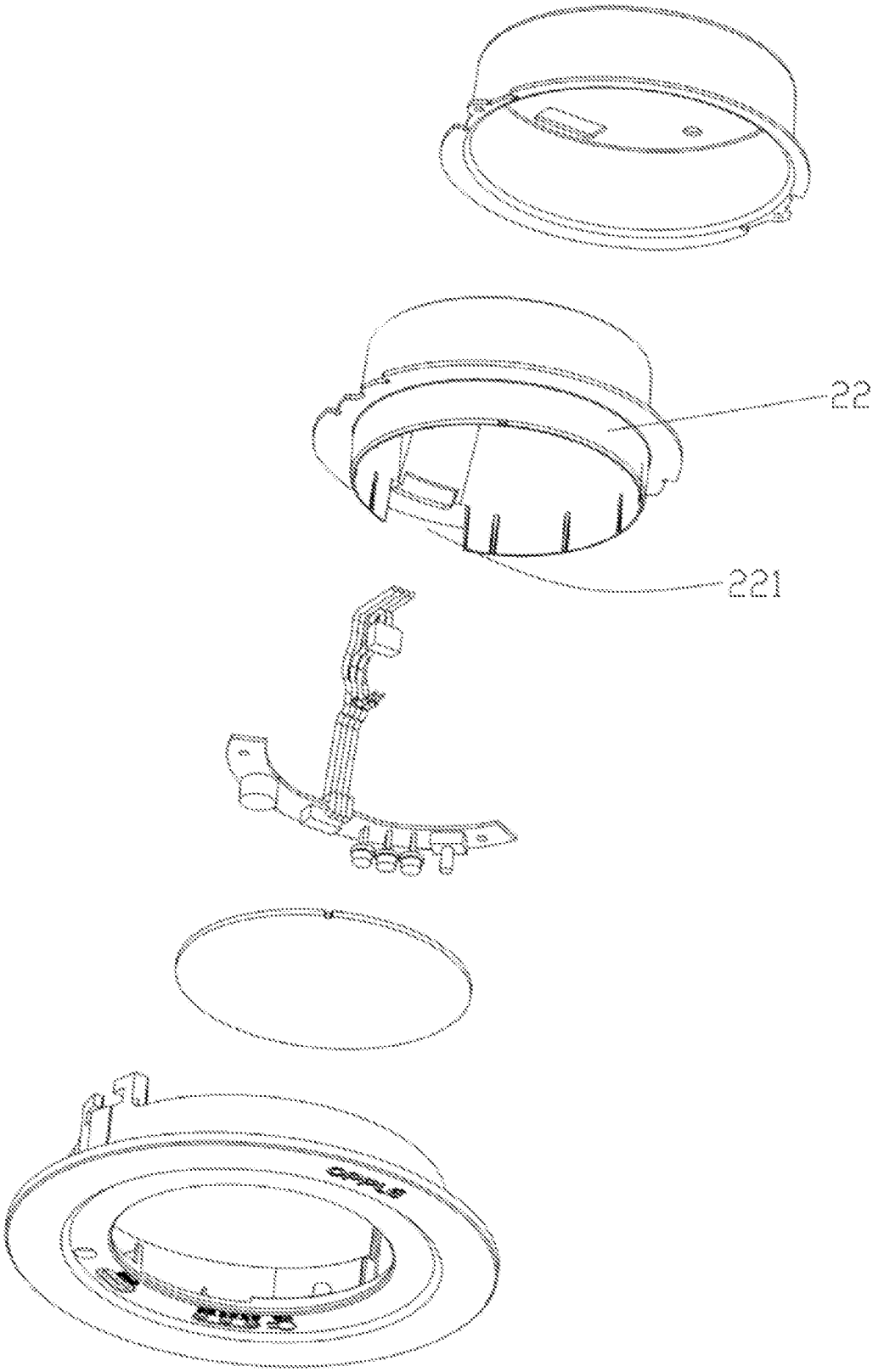
FIG. 5 is an exploded view of the lighting apparatus in FIG. 1 viewed from another visual perspective.

A side of the second portion 22 that is close to the light distributing component 70 is provided with a second via notch 221 (FIG. 5); the second via notch 221 communicates the light source cavity 111 and the installation cavity 60, so that the infrared detector may be electrically connected with the control panel 41. Except for the second via notch 221, other portion of the side of the second portion 22 that is close to the light distributing component 70 may be attached onto the light distributing component 70.

An inner surface of the second portion 22 may also be set as a mirror reflective surface, so as to reduce light loss of the light source module.

The second connecting portion 34 has a first positioning structure 341; the third portion 35 has a second positioning structure 231 that matches the first positioning structure 341; and the first positioning structure 341 is connected with the second positioning structure 231, so that the inner housing 20 and the face ring 30 may be positioned when being assembled.

The first positioning structure 341 may include a circumferential positioning stage 3411 and an axial mounting stage 3412; the circumferential positioning stage 3411 protrudes from an inner surface of the second connecting portion 34 facing towards the light source cavity 111 and extends in a direction of the light source cavity, and the axial mounting stage 3412 extends along a direction from the mounting portion 32 towards the bottom wall 14. The second positioning structure 231 may include a first notch (not labeled) located on the third portion 23; the circumferential positioning stage 3411 is clamped to the first notch; and the axial mounting stage 3412 supports the third portion 23 so that circumferential positioning and axial positioning are implemented between the inner housing 20 and face ring 30.

The outer housing 10 has a connecting plate 15 extending outwardly along the radial plane of the accommodating cavity opening; the connecting plate 15 is attached to the third portion 23 and has a third positioning structure 152; the third positioning structure 152 also includes a second notch (not labeled) that matches the circumferential positioning stage 3411, so that the outer housing 10 implements circumferential positioning and axial positioning with the inner housing 20 and the face ring 30. An end of the connecting plate 15 that extends outwardly along the radial plane of the accommodating cavity opening faces towards the second connecting portion 34, that is, the connecting plate 15 is surrounded by the second connecting portion 34.

A first connecting hole 342 is provided on a surface of the axial positioning stage 3412 that faces towards the bottom wall 14; the connecting plate 15 of the outer housing 10 is provided with a second connecting hole 151; the first connecting hole 342 and the second connecting hole 151 are aligned and connected with each other; and a fastener passes through the first connecting hole 342 and the second connecting hole 151, so as to firmly couple the outer housing 10, the inner housing 20 and the face ring 30 with one another.

It should be noted that, the axial positioning stage 3412 and the mounting post 323 extend from the mounting portion 32 and in a direction towards the bottom wall 14, but an extension length of the axial positioning stage 3412 is greater than an extension length of the mounting post 323, so that the third portion 23 is attached to the axial positioning stage 3414 without being interfered by the mounting post 323.

The structures of the respective components in the lighting apparatus according to the example of the present disclosure are described above, and assembly of the lighting apparatus 100 will be briefly introduced below.

The control panel 41 is arranged in the installation cavity 60; and the signal lamp 41, the voice prompter 42, and the detector of the functional module 40 are respectively mounted in the first mounting hole 321, the second mounting hole 322, and the third mounting hole, so as to complete the mounting and the position of the functional module 40; the first conductive wire 51 passes through the via cavity opening, the via cavity 112 and the first via hole 12; the inner housing 20 is connected with the face ring 30 and positioned; the light source module is mounted on the light source module mounting region, the second conductive wire 52 passes through the first via notch 213, the via cavity 112 and the first via hole 12; and finally, the outer housing 10 and the face ring 30 are positioned and firmly connected to each other.

In the example of the present disclosure, by providing the via cavity 112, the first conductive wire 51 is arranged in the via cavity 112, so as to prevent the first conductive wire 51 from affecting the optical path of the light source cavity 111.

In order to solve the problem that the conductive wire connecting the functional module passes through the light source cavity, rendering relatively low light efficiency, the present disclosure provides a lighting apparatus and a method of manufacturing a lighting apparatus.

The present disclosure discloses a lighting apparatus, comprising an outer housing, an inner housing, a face ring, a functional module, and a first conductive wire; wherein the outer housing has an accommodating cavity and a first via hole; a portion of the inner housing extends into the accommodating cavity and separates the accommodating cavity into a light source cavity and a via cavity; the face ring is located outside the accommodating cavity, and together with the inner housing, encloses to form an installation cavity; the installation cavity is sequentially in communication with the via cavity and the first via hole; the functional module is mounted in the installation cavity and is electrically connected with the first conductive wire; and the first conductive wire sequentially passes through the via cavity and the first via hole to extend out of the outer housing.

In the above-mentioned lighting apparatus, the outer housing has a side wall, a bottom wall and an accommodating cavity opening; the side wall is arranged to surround the bottom wall and forms the accommodating cavity opening; the bottom wall and the accommodating cavity opening are arranged opposite to each other; the first portion extends from the accommodating cavity opening toward the bottom wall; the first portion comprises a first face and a second face that face away from each other; the first face faces the via cavity; and the second face faces the light source cavity.

In the above-mentioned lighting apparatus, a projection of the first portion on the bottom wall has a loop shape; the lighting apparatus comprises a light source module; a region of the bottom wall that is surrounded by the second face is a light source module mounting region; the light source module is mounted on the light source module mounting region; and the second face is set as a mirror reflective surface.

In the above-mentioned lighting apparatus, a side of the first portion that is close to the bottom wall is provided with a first via notch; the first via notch communicates with the light source cavity and the via cavity; the lighting apparatus comprises a second conductive wire electrically connected with the light source module; and the second conductive wire passes through the first via notch, the via cavity and the first via hole to extend out of the outer housing.

In the above-mentioned lighting apparatus, the first portion separates the accommodating cavity opening into a light source cavity opening and a via cavity opening; the face ring has a light emergent port, a mounting portion, a first connecting portion and a second connecting portion; and the face ring, outwardly from a radial plane of the light emergent port, successively comprises: the light emergent port, the first connecting portion, the mounting portion, and the second connecting portion; the light emergent port and the light source cavity opening are opposite to each other; the mounting portion and the via cavity opening are opposite to each other; and the second connecting portion extends towards the bottom wall;

the inner housing comprises a second portion and a third portion that are located outside the accommodating cavity; the second portion extends from the first portion along a direction facing away from the bottom wall and is connected with the first connecting portion; and the third portion extends outwardly from the first portion along a radial plane of the accommodating cavity opening and is connected with the second connecting portion;

the mounting portion, the second connecting portion, the second portion and the third portion enclose to form the installation cavity; the functional module has a control panel; and the control panel is located in the installation cavity.

In the above-mentioned lighting apparatus, the face ring and the inner housing are made of electrically insulating materials.

In the above-mentioned lighting apparatus, the third portion covers the via cavity opening; and the third portion has a second via hole communicating with the via cavity and the installation cavity.

In the above-mentioned lighting apparatus, the functional module comprises a signal lamp; the installation cavity comprises a first mounting hole arranged on the mounting portion and in communication with the outside; and the signal lamp is mounted on the first mounting hole and is electrically connected with the control panel.

In the above-mentioned lighting apparatus, the functional module comprises a voice prompter; the installation cavity comprises a second mounting hole arranged on the mounting portion; and the voice prompter is mounted on the second mounting hole and electrically connected with the control panel.

In the above-mentioned lighting apparatus, the lighting apparatus comprises a light distributing component; the light distributing component covers the light emergent port, and is connected between the first connecting portion and the second portion.

In the above-mentioned lighting apparatus, a side of the second portion that is close to the light distributing component is provided with a second via notch; the second via notch communicates with the light source cavity and the installation cavity; the light distributing component is provided with a third mounting hole communicating the light source cavity and the outside; the functional module further comprises a detector; and the detector is mounted on the third mounting hole and is electrically connected with the control panel through the second via notch.

In the above-mentioned lighting apparatus, the second connecting portion is provided with a first positioning structure; the third portion is provided with a second positioning structure that matches the first positioning structure; the first positioning structure is connected with the second positioning structure; the outer housing has a connecting plate extending outwardly from the side wall along the radial plane of the accommodating cavity opening; the connecting plate is attached to the third portion and has a third positioning structure; and the third positioning structure is connected with the first positioning structure.

In the above-mentioned lighting apparatus, the second connecting portion is provided with a first connecting hole; the connecting plate is provided with a second connecting hole; and the first connecting hole and the second connecting hole are aligned and connected to each other.

The lighting apparatus provided by the present disclosure comprises an outer housing, an inner housing, a face ring, a functional module and a first conductive wire. A portion of the inner housing is arranged inside an accommodating cavity and separates the accommodating cavity of the housing into a light source cavity and a via cavity; the face ring is located outside the accommodating cavity and connected with the inner housing, and encloses to form an installation cavity; the installation cavity is sequentially in communication with the via cavity and the first via hole, so that the functional module mounted in the installation cavity may be electrically connected with the first conductive wire; and the first conductive wire sequentially passes through the via cavity and the first via hole to extend out of the housing, without passing through the light source cavity, so as to prevent the first conductive wire from interfering with light in the light source cavity.

The present disclosure also provides a method of manufacturing a lighting apparatus. The method may include: providing an outer housing, an inner housing, a face ring, a functional module, and a first conductive wire; providing the outer housing with an accommodating cavity and a first via hole; extending a portion of the inner housing into the accommodating cavity and separating the accommodating cavity into a light source cavity and a via cavity; locating the face ring outside the accommodating cavity, and forming an installation cavity by enclosing the face ring and the inner housing; sequentially communicating the installation cavity with the via cavity and the first via hole; and mounting the functional module in the installation cavity and electrically connecting the functional module with the first conductive wire; and sequentially passing the first conductive wire through the via cavity and the first via hole to extend out of the outer housing.

The method may also include: providing the outer housing with a side wall, a bottom wall and an accommodating cavity opening; arranging the side wall to surround the bottom wall and form the accommodating cavity opening; arranging the bottom wall and the accommodating cavity opening opposite to each other; extending the first portion from the accommodating cavity opening toward the bottom wall; providing the first portion with a first face and a second face that face away from each other; facing the first face to the via cavity; and facing the second face to the light source cavity.

The method may further include: providing a projection of the first portion on the bottom wall with a loop shape; providing a light source module for the lighting apparatus; providing a region of the bottom wall that is surrounded by the second face where the region is a light source module mounting region; mounting the light source module on the light source module mounting region; and setting the second face as a mirror reflective surface.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The objectives, technical solutions and beneficial effects of the present disclosure have been further explained in detail in the examples as described above. It should be understood that the foregoing examples merely are examples of the present disclosure, and not intended to limit the present disclosure. Any modification, equivalent substitution, improvement, and the like, made within the spirit and principles of the present disclosure should be covered within the protection scope of the present disclosure.

The invention claimed is:

1. A lighting apparatus comprising: an outer housing, an inner housing, a face ring, a functional module, and a first conductive wire; wherein the outer housing has an accommodating cavity and a first via hole; a first portion of the inner housing extends into the accommodating cavity and separates the accommodating cavity into a light source cavity and a via cavity; the face ring is located outside the accommodating cavity, and together with the inner housing, encloses to form an installation cavity; the installation cavity is sequentially in communication with the via cavity and the first via hole; the functional module is mounted in the installation cavity and is electrically connected with the first conductive wire; and the first conductive wire sequentially passes through the via cavity and the first via hole to extend out of the outer housing, wherein the outer housing has a side wall, a bottom wall and an accommodating cavity opening; the first portion separates the accommodating cavity opening into a light source cavity opening and a via cavity opening; the face ring has a light emergent port, a mounting portion, a first connecting portion and a second connecting portion; the face ring, outwardly from a radial plane of the light emergent port, comprises: the light emergent port, the first connecting portion, the mounting portion, and the second connecting portion; the light emergent port and the light source cavity opening are opposite to each other; the mounting portion and the via cavity opening are opposite to each other; and the second connecting portion extends towards the bottom wall; the side wall is arranged to surround the bottom wall and forms the accommodating cavity opening; the inner housing comprises a second portion and a third portion that are located outside the accommodating cavity.

2. The lighting apparatus according to claim 1, wherein: the bottom wall and the accommodating cavity opening are arranged opposite to each other; the first portion extends from the accommodating cavity opening toward the bottom wall; the first portion comprises a first face and a second face that face away from each other; the first face faces the via cavity; and the second face faces the light source cavity.

3. The lighting apparatus according to claim 2, wherein: the second portion extends from the first portion along a direction facing away from the bottom wall and is connected with the first connecting portion; and the third portion extends outwardly from the first portion along a radial plane of the accommodating cavity opening and is connected with the second connecting portion; and the mounting portion, the second connecting portion, the second portion and the third portion enclose to form the installation cavity; the functional module has a control panel; and the control panel is located in the installation cavity.

4. The lighting apparatus according to claim 3, wherein: a light distributing component is comprised in the lighting apparatus; the light distributing component covers the light emergent port, and is connected between the first connecting portion and the second portion.

5. The lighting apparatus according to claim 4, wherein: a side of the second portion that is close to the light distributing component is provided with a second via notch; the second via notch communicates with the light source cavity and the installation cavity; the light distributing component is provided with a third mounting hole communicating the light source cavity and the outside; the functional module further comprises a detector; and the detector is mounted on the third mounting hole and is electrically connected with the control panel through the second via notch.

6. The lighting apparatus according to claim 3, wherein: the second connecting portion is provided with a first positioning structure; the third portion is provided with a second positioning structure that matches the first positioning structure; the first positioning structure is connected with the second positioning structure; the outer housing has a connecting plate extending outwardly from the side wall along the radial plane of the accommodating cavity opening; the connecting plate is attached to the third portion and has a third positioning structure; and the third positioning structure is connected with the first positioning structure.

7. The lighting apparatus according to claim 6, wherein: the second connecting portion is provided with a first connecting hole; the connecting plate is provided with a second connecting hole; and the first connecting hole and the second connecting hole are aligned and connected to each other.

8. The lighting apparatus according to claim 3, wherein the face ring and the inner housing are made of electrically insulating materials.

9. The lighting apparatus according to claim 3, wherein: the third portion covers the via cavity opening; and the third portion has a second via hole communicating with the via cavity and the installation cavity.

10. The lighting apparatus according to claim 3, wherein: the functional module comprises a signal lamp; the installation cavity comprises a first mounting hole arranged on the mounting portion and in communication with the outside; and the signal lamp is mounted on the first mounting hole and is electrically connected with the control panel.

11. The lighting apparatus according to claim 3, wherein: the functional module comprises a voice prompter; the installation cavity comprises a second mounting hole arranged on the mounting portion; and the voice prompter is mounted on the second mounting hole and electrically connected with the control panel.

12. The lighting apparatus according to claim 2, wherein: a projection of the first portion on the bottom wall has a loop shape; a light source module is comprised in the lighting apparatus; a region of the bottom wall that is surrounded by the second face is a light source module mounting region; the light source module is mounted on the light source module mounting region; and the second face is set as a mirror reflective surface.

13. The lighting apparatus according to claim 12, wherein: a side of the first portion that is close to the bottom wall is provided with a first via notch; the first via notch communicates with the light source cavity and the via cavity; a second conductive wire is comprised in the lighting apparatus and the second conductive wire is electrically connected with the light source module; and the second conductive wire passes through the first via notch, the via cavity and the first via hole to extend out of the outer housing.

14. A method of manufacturing a lighting apparatus comprising: providing an outer housing, an inner housing, a face ring, a functional module, and a first conductive wire; providing the outer housing with an accommodating cavity and a first via hole; extending a first portion of the inner housing into the accommodating cavity and separating the accommodating cavity into a light source cavity and a via cavity, the inner housing comprising a second portion and a third portion that are located outside the accommodating cavity; locating the face ring outside the accommodating cavity, and forming an installation cavity by enclosing the face ring and the inner housing; sequentially communicating the installation cavity with the via cavity and the first via hole; mounting the functional module in the installation cavity and electrically connecting the functional module with the first conductive wire; and sequentially passing the first conductive wire through the via cavity and the first via hole to extend out of the outer housing; providing the outer housing with a side wall, a bottom wall and an accommodating cavity opening; separating, by the first portion, the accommodating cavity opening into a light source cavity opening and a via cavity opening, the side wall being arranged to surround the bottom wall and form the accommodating cavity opening; providing the face ring with a light emergent port, a mounting portion, a first connecting portion and a second connecting portion; providing the face ring, outwardly from a radial plane of the light emergent port, with the light emergent port, the first connecting portion, the mounting portion, and the second connecting portion; providing the light emergent port and the light source cavity opening opposite to each other, and providing the mounting portion and the via cavity opening opposite to each other; and extending the second connecting portion towards the bottom wall.

15. The method of claim 14, further comprising:

arranging the side wall to surround the bottom wall and form the accommodating cavity opening;

arranging the bottom wall and the accommodating cavity opening opposite to each other;

extending the first portion from the accommodating cavity opening toward the bottom wall;

providing the first portion with a first face and a second face that face away from each other;

facing the first face to the via cavity; and facing the second face to the light source cavity.

16. The method of claim 15, further comprising:

providing a projection of the first portion on the bottom wall with a loop shape;

providing a light source module for the lighting apparatus;

providing a region of the bottom wall that is surrounded by the second face wherein the region is a light source module mounting region;

mounting the light source module on the light source module mounting region; and setting the second face as a mirror reflective surface.

* * * * *